US005089807A

United States Patent [19]

Shim

[11] Patent Number: 5,089,807

[45] Date of Patent: Feb. 18, 1992

[54] ANTI-THEFT DEVICE

[76] Inventor: Henry H. Shim, 1124 S. Kingsley Dr., Los Angeles, Calif. 90006

[21] Appl. No.: 253,605

[22] Filed: Oct. 6, 1988

Related U.S. Application Data

[63] Continuation-in-part of Ser. No. 84,819, Aug. 13, 1987, abandoned.

[51] Int. Cl.[5] ..... G08B 13/14

[52] U.S. Cl. ..... 340/568; 340/636

[58] Field of Search ..... 340/568, 571, 687, 636, 340/540

[56] References Cited

U.S. PATENT DOCUMENTS

| | | | |
|---|---|---|---|
| 3,955,183 | 5/1976 | McBrian | 340/514 |
| 4,157,542 | 6/1979 | Smith | 340/568 |
| 4,237,450 | 12/1980 | Canez | 340/571 |
| 4,654,642 | 3/1987 | Groff | 340/573 |

*Primary Examiner*—Joseph A. Orsino
*Assistant Examiner*—Jeffery A. Hofsass

[57] ABSTRACT

An anti-theft device comprises a circuit which control a relay. The house power is connected to the circuit which energizes the relay. When the relay is energized, the contacts in the relay remain open. A battery and an alarm horn are connected in series with the contacts of the relay. When the power to the circuit is cut off, as during a theft, the relay is de-energized, completing the circuit to the batter and the alarm causing the alarm to sound to warn of a possible theft.

2 Claims, 3 Drawing Sheets

ANTI-THEFT DEVICE

Figure 1:
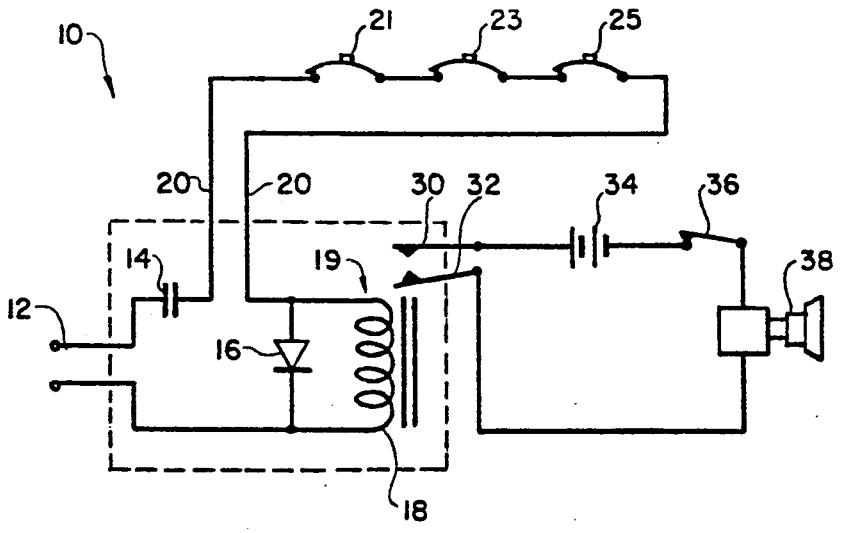

This is a continuation in part of U.S. patent application Ser. No. 084819 filed Aug. 13, 1987, now abandoned.

This invention relates generally to a an anti-theft device, and more particularly to an anti-theft device which is compact and easily concealed and operates to generate a signal when the item to which the device is attached is being stolen.

BACKGROUND AND BRIEF SUMMARY

Burglaries involving the theft of furniture, fixtures, and television sets have become increasingly common. To prevent this, great efforts have been made to devise equipment which can defeat such theft. Some of the inventions are exemplified by the U.S. Pat. Nos. to Fistell 3,553,673, King, 3,289,194, Yeski 4,535,322, Girismen 3,974,492, Taylor 4,418,336, Schulyer 3,595,790, Tellerman, 3,425,050, and Canez 4,237,450, Motto, et al 3,936,901, Smith, 4,211,995, McBrian 3,955,183, Rogers, 4,293,852, and Primont et al 4,316,181.

The problem of theft is particularly acute in hotels and motels which usually are provided with television sets, lamps, and air conditioning units. When thieves rent such a room they have plenty of time to carefully dismantle and remove this equipment, and load it in their car or truck, particularly late at night, when the sound of cars leaving the motel is common.

Although the prior alarm systems were comparatively expensive, they were vulnerable to a building power failure. For the reasons described below their cost was justified when the object was to protect an expensive art object, or a television set or an air conditioner. However these prior alarm systems were too expensive to be used to protect comparatively inexpensive objects in the motel room, such as the lamps, mattresses, chairs, and desks. These objects, although less expensive than television sets are easier to steal, and in the aggregate, stolen items of this kind, cost a great deal of money. However, prior electrically powered anti-theft devices such as those described above had several disadvantages. Many of them depended on alarm circuits which were powered by 110 volts a.c. which was a potential fire and electric shock hazard. These alarm circuits included a self contained battery to power the alarm when the item to be protected was being stolen.

The weakness with this arrangement is that it is not unusual for a power failure to occur in the building being protected by the security device. If this should happen, in many theft protecting circuits, the alarm would sound. But if the power failure should persist for a prolonged period while the owners or the managers of the property to be protected were absent, the self contained battery would become exhausted or so weakened that its useful life would be shortened or it would be unable to operate the alarm system. Then if the 110 volt power supply was restored before the owners or managers of the property returned, but after the self contained battery was exhausted or weakened, the alarm system would appear normal because, for example, the television set and other electronic devices being protected by the alarm system and powered by the house voltage, would function normally, and there would be no indication that the alarm system could not work. This is exemplified by the patent to Matto, U.S. Pat. No. 3,836,901.

To overcome this, the patent to McBrian, U.S. Pat. No. 3,955,183 has provided a test circuit 14, or 44 which is provided with a test switch. The objection to the use of a test switch is that it depends on the human factor to remember to press it frequently. The testing has to be done frequently, because even if the power system does not fail, some batteries can fail or become weakened without warning. If the battery is not tested at frequent intervals the alarm system might become inoperative if the battery should fail. Moreover, if the battery is tested too frequently, it causes a drain on the battery which in itself could accelerate the exhaustion of weakening of the battery.

In addition, as stated above, the human factor is important because managers or operators of buildings, such as motels are frequently low paid, and are apt to forget to check the alarm circuit often enough.

To overcome this problem one object of this invention is to provide an anti-theft alarm system which has a battery backup, and which is provided with a special indicator which operates automatically and without draining the battery energy, whenever the battery connected to the alarm circuit needs replacement.

In addition it would be desirable if an inexpensive alarm system could economically protect other fixtures in motel room such as the mattresses, the chairs, tables etc.

Although the circuit described in this invention was designed to prevent thefts of electronic equipment and other fixtures in places such as a hotel room, it has other practical uses. Many electronic circuits are provided with a plurality of meters and some electronic item that needs to be kept going if the primary power source fails. These circuits are usually provided with a back up battery. As will be described below, back up batteries weaken or fail for many reasons, but as long as the primary power source is functioning, the weakness or failure of the back up battery is not noticed. Some circuits have manually operated testing switches, which provide a test of the condition of the battery, but these depend on the human factor, and since the primary power source rarely fails, it is easy to forget to periodically test the condition of the battery so that when a power failure occurs, the back up battery may be inoperative.

For example, although computers have means for backing up the information being recorded, still on occasions, a power failure could occur before the information is protected, and if the computer were provided with a back up battery. this could save the operator and owner of the computer a substantial amount of work to restore the lost information. As stated above, a back up battery is one way to do this, but it would be very useful if the battery was connected to an automatic alarm circuit to indicate that the battery needs replacement, and to provide an inexpensive reliable battery condition indicator comprises another important object of this invention.

This and other objects of this invention will become more apparent when better understood in the light of the accompanying specification and drawings wherein:

FIG. 1 is a circuit diagram of a basic alarm system constructed according to the principles of this invention.

Figure 2:
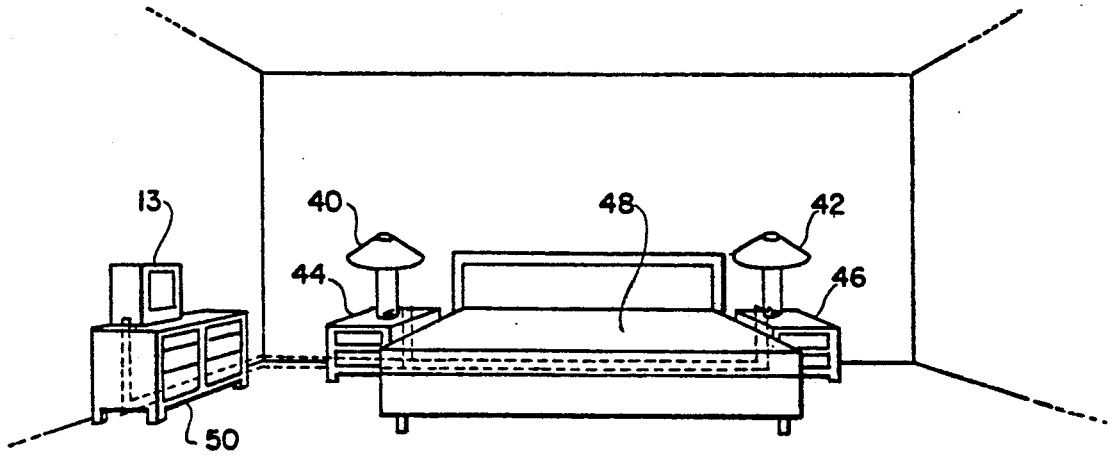

FIG. 2 discloses the same alarm system in a motel room connected to the television set, and the fixtures in the motel room including the lamps, mattresses, dressers, and end tables etc.

Figure 3:
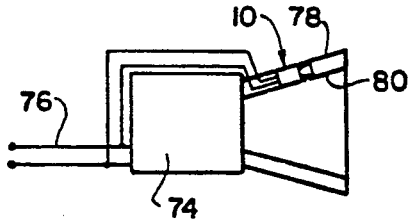

FIG. 3 discloses an alarm horn or siren used to protect government facilities that require security, and which is provided with a concealed alarm circuit which operates when power to the horn or siren is cut off.

Figure 4:
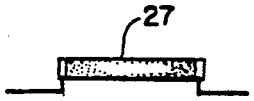

FIG. 4 discloses a wire in the circuit disclosed in FIG. 1, connected to an electrically conductive tape adapted to be attached to the fixtures being protected.

Figure 5:
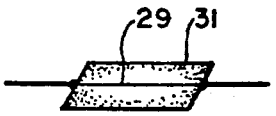

FIG. 5 discloses a wire in the circuit connected to a fine wire embedded in an adhesive tape adapted to be attached to the fixtures being protected.

Figure 6:
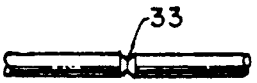

FIG. 6 discloses a wire in the circuit which has weak points which is adapted to be attached to the fixtures being protected.

Figure 7:
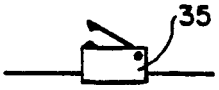

FIG. 7 discloses a microswitch on which an expensive item is designed to rest to keep the contacts of the switch closed.

Figure 8:
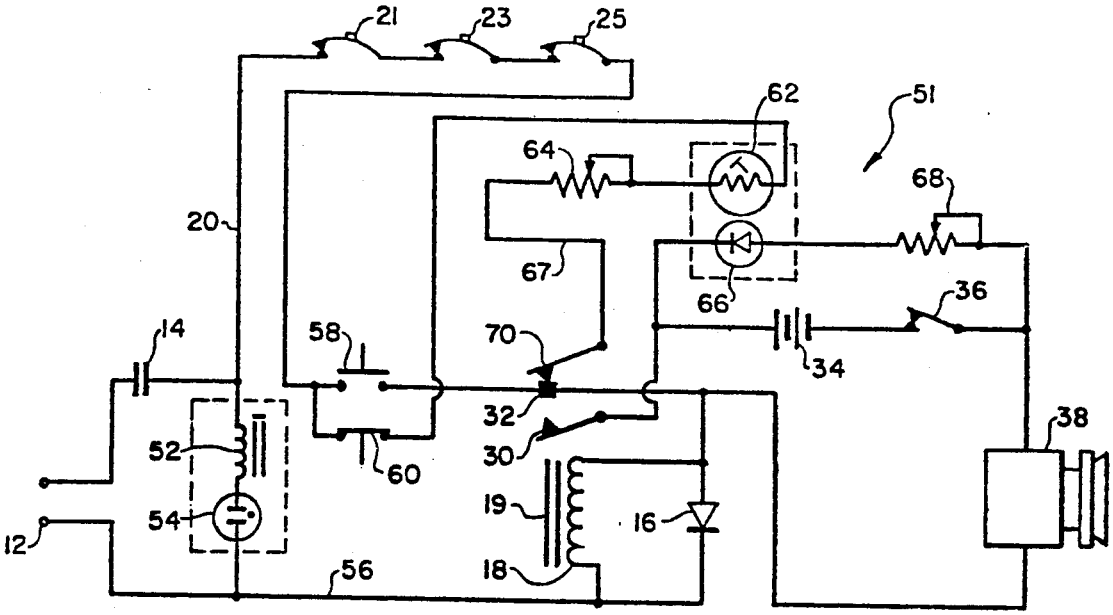

FIG. 8 discloses the operation of a modified alarm circuit provided with means for indicating that the self contained battery may be dead or in a weakened condition but showing the position of the relay contacts when the alarm circuit is in a normal operating condition with a good self contained battery.

Figure 9:
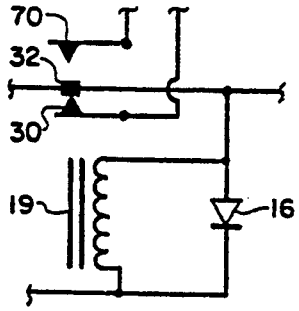

FIG. 9 discloses a portion of the circuit shown in FIG. 8 when power to the alarm circuit is cut off showing the position of the relay contacts when the relay is de-energized.

Figure 10:
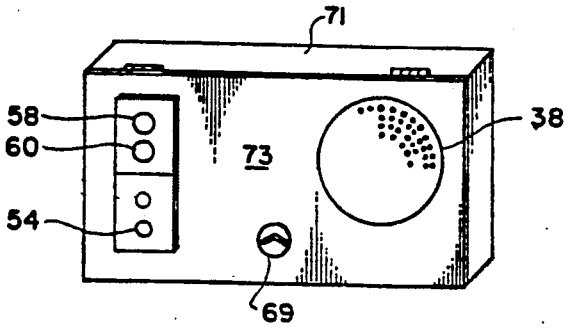

FIG. 10 discloses an enclosure containing the entire alarm circuit including the horn of the alarm system, the battery and the battery condition indicating circuit.

Figure 11:
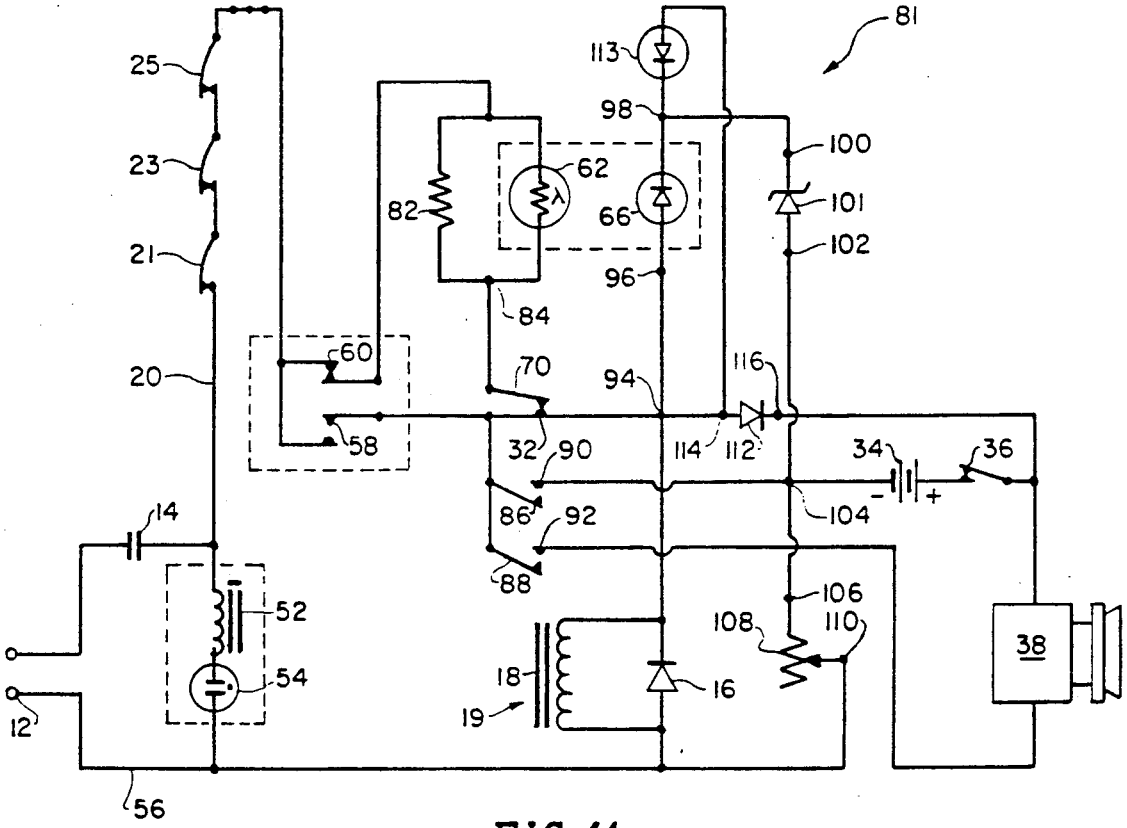

FIG. 11 discloses a modified circuit which includes one alarm or indicator that operates automatically when the battery needs to be replaced, and another alarm which operates when some item being protected is being stolen.

Figure 12:
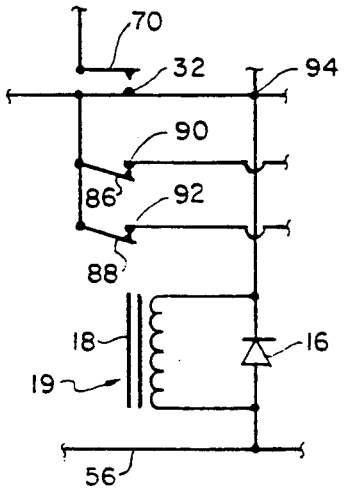

FIG. 12 discloses the modified circuit shown in FIG. 11 indicating the position of the blades of the relay when the relay is de-energized.

Referring now to FIG. 1 of the drawing, an alarm system constructed according to the principles of this invention and indicated generally by the reference numeral 10 comprises a power input plug 12 adapted to be inserted in a conventional 110 volt power outlet in a room. The power input plug 12 is connected to an electric circuit. Said electric circuit having a first part and a second part. One side of the power line is connected in series with a 0.1 uf capacitor 14, 100 working volts (W.V), and a conventional rectifier device 16 such as an ECG 116 is connected across the power input lines in parallel with a 1.7 k ohm coil 18 or some equivalent solid state device. The size of the capacitor 14 and the rectifier device 16 and the coil 18 of relay 19 is chosen so the voltage across the coil 18 is reduced to about 6 volts half wave d.c. to prevent the danger of fire or electric shock in the room being protected.

A wire 20 is connected between the capacitor 14 and the positive side of coil 18 through a plurality of series connected fragile wire portions 21, 23, 25, etc. each attached to one of the fixtures being protected. These fragile wire portions can be a conductive wire tape 27 see FIG. 4, a fine wire 29 embedded in an adhesive tape 31, see FIG. 5, weakened portions of the wire 33 adjacent the fixtures to be guarded see FIG. 7, or by microswitches 35 on which a valuable object rests so that the weight of the fixture resting on the microswitch keeps the contacts in the microswitch closed.

The wires connected to the alarm circuit may be concealed some suitable place inside a motel room. The second part of circuit 10 is designed so as long as power is connected to the coil 18, the terminals 30 and 32 of the relay 19 are separated from each other by the magnetic force of the coil 18. However, these terminals are so situated that when power to the an item being protected is cut off, either by disconnecting the item from the power outlet in the room, or by breaking wire 20 when a fixture is being stolen, the coil 18 is no longer energized so that the terminals 30 and 32 move together into electrical engagement completing the alarm circuit and causing the alarm 38 to sound.

The alarm control system is preferably situated in the office or control room of the area being protected, and indicates by sound or light that the alarm in a particular room has been triggered.

If the alarm system is installed in a typical motel room, the lamps 40 and 42, the end tables 44 and 46, the mattress 48, the dresser 50 in the motel room could all be attached to one of the fragile wires described above, of which only three are shown by way of example. The wires attached to the fixtures being protected are fragile, as described above, so they are easily broken when any attempt is made to carry away the fixtures in the room. As shown by circuit 10, when any of these fragile wires is broken, the relay 19 is de-energized so that the alarm sounds. In this way, the inexpensive alarm system 10 can be used to protect all the movable fixtures in a motel room.

As shown in FIG. 1, a control switch 36 is part of the alarm circuit and the alarm system includes a horn 38, a siren, or some other signaling device. Switch 36 permits the alarm system to be disabled in the event the fixtures being protected by the alarm system are being moved. The control switch is preferably placed in some location such as the office of the building and a key operated lock could be provided to actuate the switch.

As stated above one of the defects associated with this kind of security device is that on occasion a power failure in the building could occur, and this would cause the alarm to sound. If the power failure occurred when no one was around, the alarm would sound until the battery 34 was discharged. If the power was restored by the time the caretaker returned relay 19 would be actuated causing contacts 30 and 32 to separate so there would be no indication that the battery had been discharged.

To overcome this defect, circuit 10 has been modified in the circuit 51 shown in FIGS. 8 and 9. In this circuit if power to the circuit has been disconnected or a fragile wire has been broken which is connected to one of the fixtures, the relay 19 will be de-energized and the alarm horn 38 would sound as described above. When the relay 19 has become de-energized the terminals 70,30, and 32 move to the position shown in FIG. 9.

This supposes that the self contained battery 34 is in good condition. However, if, because of the power failure, or for some other reason the battery 34 has become exhausted the alarm horn 38 would not sound even if the circuit 51 was disconnected from the building power supply. To provide a prompt indication of a problem in the circuit 51, an indicator circuit has been added. This indicator circuit includes a buzzer 52, using a 300 ohm coil with a low ma consumption connected in series with a neon bulb 54 to one side 56 of the power line and to line 20, see FIG. 8. The buzzer and neon bulb are selected so the buzzer sounds and the neon bulb lights up when about 80 volts a.c. is connected between wire 20 and side 56 of the power input line.

As shown in FIG. 8, wire 20, after passing through the fragile portions 21, 23, 25 etc. described above, is connected to a test switch 60 which is normally closed. Test switch 60 is connected to a photocell 62 which is connected in series with a variable resistor 64. The photocell 62 is closely associated with a LED 66 which is connected in series with a variable resistor 68 for reasons to become apparent below.

With the power disconnected from the circuit 51, as shown in FIG. 9 but with a good battery 34, no power is delivered to relay 19 so the contacts 30 and 32 engage each other completing the circuit to the alarm 38 to sound the alarm.

It is noted that the variable resistors 64 and 68 are adjusted so that if the battery 34 is in good condition it cause the LED 66 to light up, and this light actuates the photocell 62. The variable resistor 68 and the variable resistor 64 are adjusted so the light emitted by the LED is just sufficient to actuate the photocell 62 with a minimum drain on the battery. In addition, the variable resistor is adjusted to permit sufficient current to flow through wire 67 to terminal 70 to complete the alarm circuit, if the circuit is energized properly. In this way, if the relay 19 is de-energized, the electrical connection between terminals 70 and 32 will be broken, as shown in FIG. 9 while terminal 30 moves into engagement with terminal 32 causing the alarm horn 38 to sound if the battery 34 is in good working order.

As will be described below, in order for the buzzer 52 to sound and the neon bulb 54 to light up, at least 80 volts a.c. is necessary across wires 20 and wire 56. The circuit is designed so this happens when the relay 19 is de-energized, as when there is a power failure in the building or a break in the wire 20 connected to switches 21,23, and 25. The sound of the buzzer and the sight of the neon bulb 54 indicates that the relay 19 has been de-energized. When these circuit elements operate, the current flowing through them will be small, because of capacitor 14, thereby eliminating the danger of fire and shock. The sound of the buzzer and the lit neon bulb 54 automatically notifies the operator of the premises being protected that something is wrong either in the building power supply or in the battery 34.

To remedy this situation, after the power 110 volt power has been restored, the operator closes reset switch 58 which is normally open leaving switch 60 closed. If none if the fragile wires in line 20 has been broken, and relay 19 and the rectifier 16 are in good condition, relay 19 will be energized and terminal 30 will move out of engagement with terminal 32 and into engagement with terminal 70 causing the alarm 38 to sound.

When relay 19 is energized, the effect of the capacitor 14 which in circuit 51 is a 0.22 uf 100 w.v and the coil 18 and rectifier 16 is to maintain the voltage across the relay 19 to around 8 volts half wave D.C. Since the relay 19 and the rectifier 16 are in parallel with the buzzer and the neon lamp, this drop in voltage across the relay caused by closing reset switch 58 will drop the voltage across the buzzer 52 and the neon light 54, so there will be insufficient voltage to energize the buzzer and the neon light thus turning them off. This indicates that the battery is in good condition.

If when the switch 58 is opened, and the relay 19 remains de-energized,, the buzzer 52 will sound and the neon light will turn on, indicating that the battery is dead. In this is way all the components of the circuit are tested.

As indicated above, with the switch 60 closed, and with the battery 34 in good condition, the LED 66 will emit enough light to excite the photocell 62, causing current to flow to terminal 70 through wire 67. When this happens the circuit to relay 19 is completed through terminal 70 contacting terminal 32, so then if the contacts of switch 58 are opened, the switch 58 will be bypassed by the current flowing through switch 60 and on through the photocell 62 through wire 67 so the relay 19 will remain energized.

However, if the battery 34 has become drained or weakened, after the contacts in switch 58 has been opened, the current from the battery 34 will be insufficient to power the relay 19, so that the relay will become de-energized, and this will turn on the buzzer 52 and the neon bulb 54, automatically notifying the operator that the battery needs replacement.

With the arrangement described above it is seen that the battery 34 serves a dual function First it operates the alarm when there is an attempted theft of a item being protected. Second, it is part of an indicator circuit which automatically indicates that the battery needs replacement The entire circuit may be mounted inside a container 71, as shown in FIG. 10 The horn 38 and the buzzer 52 are mounted inside the container. The switches 58 and 60 and the neon bulb 54 along with the LED 113 (to be described below) are mounted on the outer surface of the container. Access to the interior of the container may be through a lock 69 which when opened permits the wall 73 of the container to be removed so that the battery 34 may be replaced, or the rest of the circuit inspected and repaired.

Referring now to FIG. 3 in the drawings, in some situations, an area is guarded by sirens or security horns 74, and attempts may be made to disable these security devices by cutting their power input lines 76. These sirens could be designed so they have a double wall, as shown in FIG. 3 with the anti-theft device 10 mounted between the inner and outer walls 78 and 80. In this way, if an attempt is made to cut the power lines 76, the alarm circuit would be triggered alerting the security staff that something is wrong.

Experience has shown that the circuit 51 disclosed in FIGS. 8 and 9 of the drawing functions well as long as the voltage across battery 34 does not drop very much. However, as the battery ages, or becomes drained, the voltage will drop, and as the voltage drops the sound emitted by the alarm horn 38 becomes weaker. Moreover, in the circuit shown in FIG. 8, the light emitting diode 66 is always on causing a constant drain on the battery. This drain, although small, causes battery 34 to become exhausted in an unacceptably short time.

To overcome this problem, the circuit 81 disclosed in FIG. 11 has been provided. In this circuit the magnitude of the capacitor 14 is 0.33 uf, 100 w.v, the value of the capacitor being dependent on the parameters of the circuit components necessary to raise the voltage across the coil 18 half wave d.c. to the required amount. However a limiting value on the magnitude of the capacitor 14 is that value which causes the photocell 62 to overheat. The magnitude of the variable resistor 64 is 25 k ohm ½ watt This variable resistor 64 is in parallel with the photo cell 62 which in this embodiment is a Zenith Part #800-617 or #162-9 but without the attached lamp. The common terminals 84 of the variable resistor 64 and photocell 62 are connected to the blade 70 of the relay 19, which in this embodiment is a 1.7 k ohm relay, and in the power on position, this blade is connected to terminal 32. In the power off position, the blade 70 is disconnected from terminal 32, see FIG. 12.

The relay 19 also controls blades 86 and 88, which in the power on position are disconnected from terminals 90 and 92. In the power off position, the relay 19 is off and the blades 86 and 88 move into engagement with terminals 90 and 92, and this completes the circuit to the alarm 38 causing the alarm to sound, see FIG. 12. Although to this point the electronic circuit has described in terms of conventional relays and blades, this is for illustration only, and the circuit could be designed by conventional means so that only solid state devices are used.

The diode 16 in parallel with the coil 18 is connected to terminal 94 and is in series with one side of the light emitting diode 66 at terminal 96. The LEDS in this particular circuit are a 1.93 volt, 5 ma, red light, such as a RCA Part #149982 or its equivalent. The opposite side of the LED 66 at terminal 98 is connected to one side of terminal 100 of a zener diode, 101 which in this embodiment is identified in the art as a E.C.G. 5012 a 6 volt, ½ watt zener diode. But this choice of the zener diode could be changed, depending on the magnitude of the battery voltage drop selected to trigger a circuit cut off, to compel replacement of the battery.

The opposite terminal 102 of the zener diode 101 is connected to terminal 104 which as shown is connected to the negative side of battery 34, which in circuit 81 is a duracell #MN 1604 alkaline 9 volt battery which has the appropriate battery characteristics and internal resistance. It is understood, however that under other circuit conditions, other batteries could be used. The positive terminal of the battery 34 is connected through the alarm 38 to the relay blade 92. The terminal 106 is a 10 K, ½ watt variable resistor 108. The slider 110 of the variable resistor is connected to wire 56 which leads to the power input 12.

A rectifying diode 112, identified in the art as ECG 116 has one terminal 114 connected, as shown in FIG. 11 to terminal 94 and the opposite terminal 116 is connected to the positive side of battery 34 and to the alarm 38.

Test switch 60 is normally closed and reset switch 58 is normally open. These are push button type switches and they are actuated only as long as pressure is exerted on them. If switch 60 is pushed open momentarily to test the battery, then power to relay 19 is cut off and the blades 86 and 88 move to the position shown in FIG. 12. If the battery is in good condition, the alarm 38 sounds and at the same time the buzzer 52 and neon bulb 54 are activated. At this point, even if switch 60 is closed, the alarm 38 and the buzzer and the neon bulb will continue to operate. This is because blade 70 is in the position shown in FIG. 12 so that power is not delivered to the relay 19. To reset the circuit, the reset switch 58 must be momentarily pressed. This delivers power to the relay 19 and causes the blades 70, 86 and 88 to move to the position shown in FIG. 11. This condition persists even after the switch 58 is allowed to open because now power is delivered to the relay 19 through blade 70 so that the battery powered alarm is cut off and the activation of the relay 19 reduces the voltage across the buzzer 52 and the neon bulb 54 to a level where they cannot operate.

On the other hand if the reset switch 58 is momentarily pressed, but the battery operated alarm and the buzzer 52 and the neon bulb 54 continue to operate, this means that the relay 19 is not energized so that the voltage rises across the buzzer and the neon bulb, turning them on. This indicates a possible theft of articles being protected by the circuit 81 has occurred, or that a part of the wire 20 leading to the articles being protected has become defective.

An indicator LED 113 which is the same part as LED 66 is mounted on the surface of the housing 71 shown in FIG. 10 and is parallel with LED 66. Consequently this LED 113 lights up when LED 66 lights up and turns off when LED 66 turns off. With this arrangement, when the operator of the circuit inspects the antitheft device, the sight of the LED 113 in an on condition indicates that the circuit is operating and the battery is in good condition.

The procedure for setting up the circuit 81 is as follows:

The circuit is initially connected at 12 to the household power line. A voltmeter which has the range of 30 volts d.c. is connected between terminals 56 and 104. Next the regular 9 volt battery 34 must be removed and replaced by a testing battery of about 4 volts d.c. Then the slider of the variable resistor 64 is set to 0 and the slider of the variable resistor 108 is set to (a maximum which is) about 10 k ohms. If the circuit is properly adjusted, the voltmeter should now read about 15 volts. Then the slider 110 of the variable resistor 108 should be adjusted until the voltmeter indicates the zener value plus 4 volts, e.g. if the zener is 6 volts diode, then the slider should be adjusted until the voltmeter reads 10 volts.

When this is done the slider of the variable resistor 64 should be adjusted to a higher value until the buzzer 52 and the neon bulb 54 just begin to operate. If the circuit is properly adjusted, the buzzer 52 and the neon bulb 54 should stay on. Then the testing battery and the voltmeter used with the testing battery is removed and the reset switch 58 is pressed to turn the buzzer 52 and the neon bulb 54 off. After this the normal 9 volt d.c. battery 34 is installed In summary, circuit 81 has two kinds of power. One is a very low current a.c. supplied from the capacitor 14 and maintained by diode 16 half wave d.c, and the other is the 9 volts d.c. battery 34. With this arrangement there is no drain on battery 34.

Although the diode 112 acts as a barrier and prevents the battery 34 from draining, the battery voltage 34 will drop in the course of time, because of age, use, or prolonged power failure. This drop in battery voltage could disable the circuit. For this reason it is important for the circuit to be designed so it automatically compels a battery replacement before the battery voltage drops to a level which could prevent the anti-theft circuit from working.

In summary, as stated above, circuit 81 is adjusted so under normal conditions the zener diode is conductive to the current. But if the battery voltage drops below the zener diode voltage, which in this case is around 6 volts, then the zener diode become non-conductive, like an open switch. This turns the Leds 113 and 66 off and in addition this turns off the photo cell 62. This raises the voltage between the terminals 56 and 20 which turn on the buzzer 52 and the neon lamp 54 indicating that the battery 34 needs replacement.

Heretofore, the circuits 10, 51, and 81 have been described as anti-theft circuits. However the concepts set forth in this invention have a greater utility. For example, the fragile wires described above as 21, 23, 25, etc. could be electrical meters etc. and the horn 38 could be some complex electronic item that requires a battery backup. This same circuit could indicate whenever any of the meters, 21,23, 25, etc, have become defective, or that the battery back up for the complex electronic item needs replacement. This greatly expands possible uses of this device.

Referring again to FIG. 1 of the drawing, the switches 21, 23, and 25 are shown as fragile wires or micro switches. It is to be understood, that some of these switches could be optically activated by use of conventional light activated switches, so that if someone entered a protected room and turned on the lights, one of the switches would open and the alarm would be triggered. Similarly some of the switches 21, 23, 25 etc. could be conventional vibration activated switches which responds to the footsteps of a person entering a protected room and open wire 20 turning off coil 18.

As stated above, although circuits 10, 51, and 81 have been illustrated as a conventional electronic circuit, it is understood that the elements of these circuits could be replaced by solid state devices which have the same function, so that the term relay, and blades, etc. should be interpreted to include equivalent solid state devices which perform the same function.

Having described the invention what I claim as new is:

1. An anti-theft device for use in a motel room comprising a first circuit and a second circuit, said first circuit having a power input from a power outlet in the room, electrical components in said first circuit for reducing and rectifying the voltage coming from the conventional power outlet to prevent electric shock and to reduce the danger of fire, a coil in said first circuit, said reduced and rectified voltage in said first circuit connected across said coil, a plurality of fragile series connected wires attached to the items in the motel room to be protected from theft, said wires connected to said circuit in such a way that as long as the wires to the coil are not broken, the coil is energized by said voltage and a pair of contacts in said second circuit are kept separated from each other, a battery and a first alarm connected in series with said pair of contacts, so that when the voltage to said coil is cut off said pair of contacts come together to close the contacts actuating the alarm to warn the owner that objects in the motel room are being stolen, and an automatic indicator in the first circuit, said automatic indicator connected to the first circuit in such a way that voltage changes in the second circuit which occur when the battery becomes weakened or drained cause a second alarm to be actuated to warn the operators of the anti-theft equipment that the battery needs to be replaced.

2. An anti-theft device for protecting fixtures and electronic equipment comprising an electric circuit, said electric circuit connected to a 100 volt power outlet in parallel with the electronic equipment, a 0.1 uf ac capacitor connected to one side of the power input, a wire connected to the opposite side of the capacitor, said wire connected to various fixtures to be protected, a portion of said wire adjacent each fixture to be protected, the opposite end of said wire connected to the positive side of ecg116 rectifier, the opposite side of said rectifier connected to the opposite side of the power input to reduce the voltage across the rectifier to 6 volts D.C. to reduce the danger of fire and electric shock, a 1.7 K ohm coil connected in parallel with said rectifier in such a way that as long as there is six volts D.C. across the coil, a pair of contacts remain separated, a battery and first alarm connected in series with said contacts in such a way that when an attempt is made to cut off power to the fixtures being protected, the weakened portion of the wire adjacent the fixture being carried away breaks and power across the coil is cut off cause said contacts to come together, whereby the circuit to the first alarm is completed and the first alarm is actuated warning the owners of the property that objects are being taken, and an automatic indicator in said anti-theft device, said anti-theft device connected to said circuit in such a way that changes in the voltage which occur when the battery becomes weakened or drained turn on a second alarm to warn the operator of the anti-theft equipment that the battery needs replacement.

* * * * *